US005324608A

United States Patent [19]

Gerriets et al.

[11] Patent Number: 5,324,608

[45] Date of Patent: Jun. 28, 1994

[54] PHOTOCONDUCTOR DRUM, HAVING A NON-CONDUCTIVE LAYER, WITH AN AREA OF ELECTRICAL CONTACT AND METHOD OF MANUFACTURING THE SAME

[75] Inventors: Frederick W. Gerriets; John E. LaRegina, both of Virginia Beach; Timothy E. Groff, Norfolk, all of Va.

[73] Assignee: Mitsubishi Kasei America, Inc., White Plains, N.Y.

[21] Appl. No.: 979,886

[22] Filed: Nov. 23, 1992

[51] Int. Cl.[5] ..... G03G 5/10

[52] U.S. Cl. ..... 430/60; 430/131; 430/945

[58] Field of Search ..... 430/60, 945, 5, 209, 430/231, 131

[56] References Cited

U.S. PATENT DOCUMENTS

| | | | |
|---|---|---|---|
| 3,037,861 | 6/1962 | Hoegl et al. | 96/1 |
| 3,232,755 | 2/1966 | Hoegl et al. | 96/1 |
| 3,271,144 | 9/1966 | Clausen et al. | 96/1 |
| 3,287,120 | 11/1966 | Hoegl et al. | 96/1.5 |
| 3,341,326 | 9/1967 | Snelling | 430/60 |
| 3,573,906 | 4/1971 | Goffe et al. | 96/1.8 |
| 3,725,058 | 4/1973 | Hayashi et al. | 96/1.5 |
| 3,837,851 | 9/1974 | Shattuck et al. | 96/1.5 |
| 3,839,034 | 10/1974 | Wiedemann | 96/1.5 |
| 3,850,630 | 11/1974 | Regensburger et al. | 96/1.5 |
| 3,911,444 | 10/1975 | Lou et al. | 430/945 |
| 4,054,094 | 10/1977 | Caddell et al. | 430/945 |

OTHER PUBLICATIONS

Electrophotography, vol. 8, pp. 794–826, N. Wolff, et al.

Encyclopedia of Electronics, TAB Professional and Reference Books, 2nd Edition, S. Gibilisco, et al., pp. 669–671.

*Primary Examiner*—John Goodrow

*Attorney, Agent, or Firm*—Oblon, Spivak, McClelland, Maier & Neustadt

[57] ABSTRACT

Forming an area of good electrical contact on a photoconductor drum, having a non-conductive layer, by means of a laser beam leads to a reduction in the loss rate in the manufacturing process. The area of electrical contact is introduced without the use of caustic or corrosive chemicals and without the production of waste products, such as metal powder or spend chemicals. The drums produced by the process are free of scratches which arise from other methods, free of chemical residues in the area of electrical contact, and have an area of electrical contact which is even and smooth.

19 Claims, 4 Drawing Sheets

PHOTOCONDUCTOR DRUM, HAVING A NON-CONDUCTIVE LAYER, WITH AN AREA OF ELECTRICAL CONTACT AND METHOD OF MANUFACTURING THE SAME

BACKGROUND OF THE INVENTION

Field of the Invention

The present invention relates to a method of manufacturing an organic photoconductor drum, having a non-conductive layer, with an area of electrical contact and the drum produced by the method.

Discussion of the Background

A general discussion of electrophotography (photocopying) is given in *Kirk-Othmer, Encyclopedia of Chemical Technology,* ed, vol. 8, pp. 794–826, Wiley, New York (1979), and a brief description of laser beam printing is provided in *Encyclopedia of Electronics,* 2nd ed, Gibilisco et al, Eds., pp. 669–671, TAB BOOKS Blue Ridge Summit Pa. (1990), both of which are incorporated herein by reference.

Photoreceptors are the central device in photocopiers and laser beam printers. In most photocopiers and laser beam printers, the photoreceptor surface is contained on the outside surface of a hollow metal cylinder, called a drum. Typically, the drum is made of metal having a non-conductive layer, such as anodized aluminum, which may be coated with a thin dielectric layer (injection barrier) which is in turn coated with the photoconductive layer.

Key steps in transfer xerography include the charging step, the exposure step, the development step, and the transfer step. In the charging step, gas ions are deposited on the surface of the photoconductor drum. In the exposure step, light strikes the charged photoreceptor surface and the surface charges are neutralized by increased conductivity across the photoreceptor layer. The charge on the surface is transmitted by the photoconductor layer to the oppositely charged metal substrate of the drum. In the development step, a thermoplastic pigmented powder (toner) which carries a charge opposite to the surface charges on the photoreceptor is brought close to the photoreceptor so that toner particles are attracted to the charged regions on the photoreceptor. In the transfer step, the sheet of paper is brought into physical contact with the toned photoreceptor and the toner is transferred to the paper by applying a charge to the back side of the paper.

Accordingly, to insure that the exposure step proceeds quickly and efficiently, it is required that good electrical conduct be made between the metal substrate of the drum and the ground. However, as noted above, the metal drum is often composed of a metal having a non-conductive layer on the surface, such as anodized aluminum, which precludes effective electrical contact. Thus, it is necessary to remove at least a portion of the non-conductive layer from the surface to provide a region to which good electrical contact can be made.

To date, a number of methods have been employed to remove a portion of the non-conductive layer to afford an electrical contact point. Such methods include manual abrasion with, e.g., a dremel tool, chemical etching with, e.g., sodium hydroxide, and grinding with a grinding strap. However, all of these methods suffer from serious drawbacks. Manual grinding is labor intensive and time consuming and is accompanied by a high loss or fall out rate. Both manual and mechanical grinding produce ground metal as a waste product. Chemical etching utilizes caustic and corrosive chemicals and, thus, requires special safety and handling techniques. In addition, the disposal of the spent chemicals can be expensive.

In principle, an area of electrical contact can be created by using a mask during the formation of the non-conductive layer. In this procedure, a mask, corresponding to the area of electrical contact, is placed on the metal drum before the step in which the non-conductive layer is formed. Removal of the mask, after the non-conductive layer-forming step, reveals a patch of exposed metal to which good electrical contact can be made. However, this approach also suffers from serious drawbacks. Again, the use of chemicals in the mask forming and removal steps necessitates special safety and disposal steps. Perhaps more importantly, the masking approach is not 100% effective, and, thus, it is necessary to employ a second technique, such as grinding, to ensure good electrical contact.

Thus, there remains a need for a method for forming an area of good electrical contact on a photoconductive drum having a non-conductive layer, which does not utilize caustic chemicals, is not labor intensive, does not produce a waste product, such as ground metal or spent chemicals, and is highly effective.

In addition, the conventional methods for introducing an area of electrical contact on a photoconductor drum having a non-conductive layer yield drums which are unsatisfactory in a number of respects. For example, the drums subjected to either manual or mechanical grinding are often marred by scratches, and the surface of the area of electrical contact, produced by such methods, is often uneven and rough, leading to inadequate electrical contact. Drums subjected to a chemical etch are often characterized by a variation in the depth of the chemical etch, which can lead to arcing between the drum and the electrical contact. In addition, chemical etching can leave a residue on the surface of the exposed metal. Similarly, drums in which the area of electrical contact is introduced by the use of a mask during the non-conductive layer-forming step may also possess chemical residues on the surface.

Thus, there also remains a need for photoconductor drums, having a non-conductive layer, with an area of electrical contact, which contain an even and smooth surface in the area of electrical contact, are free of scratches, and are free of chemical residues in the area of electrical contact.

SUMMARY OF THE INVENTION

Accordingly, it is one object of the present invention to provide a method for manufacturing a photoconductor drum, having a non-conductive layer, with an area of electrical contact.

It is another object of the present invention to provide a method for manufacturing a photoconductor drum, having a non-conductive layer, with an area of electrical contact, which does not use caustic or hazardous chemicals during the introduction of the area of electrical contact.

It is another object of the present invention to provide a method for manufacturing a photoconductor drum, having a non-conductive layer, with an area of electrical contact, which does not produce a waste product during the introduction of the area of electrical contact.

It is another object of the present invention to provide a method for manufacturing a photoconductor drum, having a non-conductive layer, with an area of electrical contact, in which the introduction of the area of electrical contact is not labor intensive and is highly efficient.

There also remains a need for photoconductor drums, having a non-conductive layer, which contain an area of electrical contact and are free of scratches.

There also remains a need for photoconductor drums, having a non-conductive layer, which contain an area of electrical contact and are free of chemical residues on the surface of the area of electrical contact.

There also remains a need for photoconductor drums, having a non-conductive layer, which contain an area of electrical contact in which the surface of the area of electrical contact is characterized as being even and smooth.

These and other objects, which will become apparent during the following detailed description, have been achieved by the inventors' discovery that an area of good electrical contact may be formed on a photoconductor drum, having a non-conductive layer, by etching the non-conductive layer from a region of the surface of the drum by means of a laser beam. The inventors have found that, by removing an area of the non-conductive layer by means of laser etching, an area of electrical contact may be efficiently formed without the use of caustic or hazardous chemicals and without the formation of a waste product. The inventors have also discovered that the drums produced by the present method are substantially free of scratches, free of chemical residues in the area of electrical contact, and possess an area of electrical contact which is characterized by a smooth and even surface.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
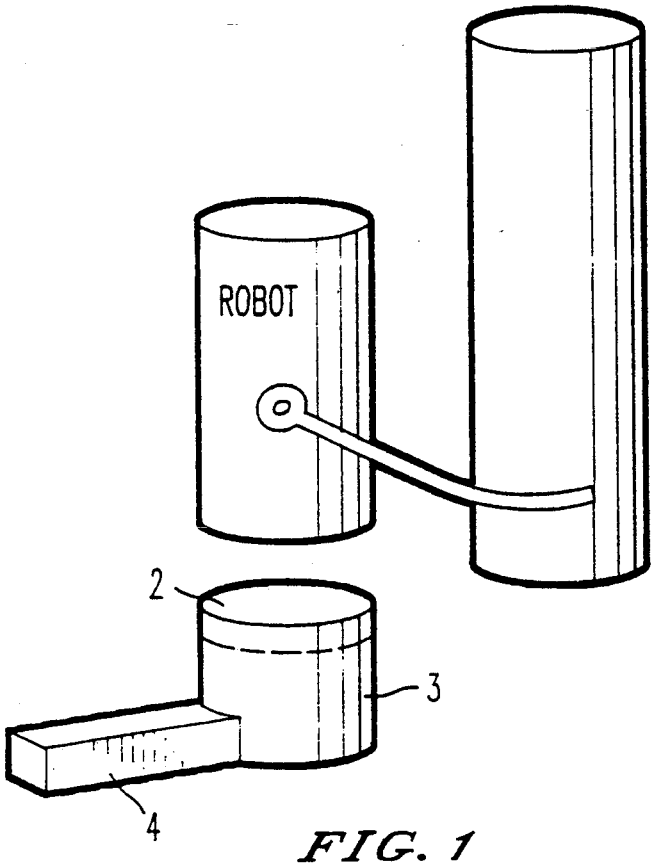
FIG. 1 schematically illustrates an apparatus for carrying out the present method.

Thus, the present invention provides a method for manufacturing a photoconductor drum, having a non-conductive layer, with an area of good electrical conduct. Specifically, the present method involves removing the non-conductive layer from at least a portion of the surface of a photoconductor drum having a non-conductive layer, by means of a laser beam, to create an area of good electrical contact.

Suitably, the present invention may be practiced with any metal drum, having a non-conductive layer, which requires an area of good electrical contact. Although there are no particular size limitations placed on the metal drum, such drums are typically a hollow cylinder which is 10 to 100 cm long and 2 to 30 cm in outer diameter. Typically, the thickness of the aluminum is 0.5 to 2 mm, and thus the inner diameter of the drum is usually close in size to the outside diameter of the drum.

There is no particular limitation on the metal which composes the metal drum, and any of those used conventionally in the art may be employed. Preferably, the metal drum is an aluminum drum.

In the context of the present invention, the term "non-conductive" layer refers to (i) an oxide layer formed by, e.g., an anodizing process, a plating process, or a wet oxidation process using $H_2SO_4$ or $HNO_3$, or (ii) a coating of an inorganic (e.g., a glass or ceramic) or organic (e.g., a rubber or other non-conductive polymer) material. Such non-conductive layer-forming processes may be carried out by the conventional methods well known in the art (see e.g., *Kirk-Othmer, Encyclopedia of Chemical Technology,* 3rd Ed., vol. 15, pp. 296–324, Wiley, N.Y., 1981, which is incorporated herein by reference). Good results have been achieved by applying the present method to anodized aluminum drums.

The photoconductor drum may be coated on the outside with any of the conventional photoconductors used in electrophotography or laser beam printing. Such photoconductors include inorganic photoconductors, such as vitreous selenium, and organic photoconductors, such as polynuclear aromatic and heterocyclic compounds. Such photoconductors are disclosed in U.S. Pat. Nos. 3,037,861, 3,232,755, 3,271,144, 3,287,120, 3,573,906, 3,725,058, 3,837,851, 3,839,034, 3,850,630, 4,746,756, 4,792,508, 4,808,506, 4,833,052, 4,855,201, 4,874,682, 8,882,254, 4,925,760, 4,937,164, 4,946,754, 4,952,471, 4,952,472, 4,959,288, 4,983,482, 5,008,169, 5,011,906, 5,030,533, 5,034,296, 5,055,367, 5,066,796, 5,077,160, 5,077,161, 5,080,987, 5,106,713, and 5,130,217, which are incorporated herein by reference. The photoconductor may also include a dye for wavelength sensitization.

Depending on the final application of the photoconductor drum, the entire outside surface of the drum may be coated with photoconductor, or the photoconductor coating may be omitted from either one or both of the end portions of the outside surface of the photoconductor drum. The omission of a photoconductive layer from a single end region of the drum may be accomplished by simply controlling the depth of immersion of the drum into the coating both during the coating step, and the omission of the photoconductive coating from both ends of the drum can be accomplished by combining controlling the depth of immersion with either wiping the end portion of the drum immersed in the coating bath or equipping this end portion with a mask during immersion.

It is suitable to create the area of electrical contact by laser etching either before or after the drum, having a non-conductive layer, is coated with the layer(s) of photoconductor and/or dielectric (injection) barrier, and no particular preference is attached to carrying out the laser etching step either before or after the coating of the drum with the photoconductor and/or dielectric (injection) barrier.

In theory, it is possible to use the laser etching step to create the area of electrical contact on either the outside surface or the inside surface of the drum. However, it is preferred that the area of electrical contact be made on the inside surface of the drum, so that electrical contact can be made with a metal piece contained on a cap inserted into an end of the drum.

There are no particular limitations on the shape and size of the area of electrical contact so long as this area does not interfere with the photoconductor coating. In fact, it is possible to use the present method to create more than one region of electrical contact in the same drum, and the present invention includes those drums containing more than one region of electrical contact. When more than one area of electrical contact is present in the same drum, it is again preferred that these areas be present on the inside surface of one end of the drum.

Typically, the area of electrical contact will be $\geqq 1$ $mm^2$ and preferably $\geqq$ about 3 $mm^2$. Good results have been achieved using areas of electrical contact which are 5 mm×9 mm rectangles, although other shapes such as squares, circles, ovals, etc. may be used. In addition, it is possible to use a plurality of such regions of electrical contact. Alternatively, the area of electrical contact may take the shape of a band which covers a continuous path around the inside surface of the drum. Such a band is typically $\geqq 1$ mm wide, preferably $\geqq 3$ mm wide.

Typically, the non-conductive layer on the metal drum will have a thickness of 3–9 μm, usually about 6 μm. Thus, it is necessary to use a laser with sufficient power for a sufficient time to remove the non-conductive layer. Moreover, it has been found that it is preferable to remove a portion of the metal beneath the non-conductive layer removed. Thus, for a drum with a thickness of 750 μm, it has been found advantageous to remove the metal, beneath the removed non-conductive layer, to a depth of 50 to 100 μm.

The particular type of laser used in the present method is not critical, so long as the laser has sufficient power at an appropriate wavelength to remove the non-conductive layer. Good results have been achieved using a Signature Nd:YAG laser manufactured by Control Laser of Orlando, Fla., with a wavelength of 1.064 nm and maximum power of 50 Watts. The particular power setting of the laser and time of the laser etching will, of course, depend on the thickness of the non-conductive layer, the depth of the underlying metal to be removed, the identity of the metal, the size of the area from which the non-conductive layer is to be removed, and the wavelength of light used. However, the selection of an appropriate laser power and time of etching is well within the abilities of one of skill in the art. Suitably, the irradiation time will be 0.01 to 0.2 sec/$mm^2$ of surface etched, preferably 0.04 to 0.1 sec/$mm^2$ of surface etched. Suitably, the power will be 10 to 200 Watts, preferably 20 to 50 Watts. As an example, good results have been achieved by using a Signature Nd:YAG laser manufactured by Control Laser of Orlando, Fla. with a power setting intensity of 30 Watts at 1.064 nm, to remove 6 μm of anodized aluminum and 50 μm of underlying aluminum, with an irradiation time of about 0.064 sec/$mm^2$ of irradiated area.

The laser beam may be brought to bear on the drum by conventional optics, and the precise location of the incidence of the beam on the drum may be controlled by adjusting either the location of the drum, the optics (and/or laser itself) or both. Thus, the relative position of the drum and the laser beam may be controlled by either: (i) holding the drum stationary and moving the laser beam; (ii) holding the laser beam stationary and moving the drum: or (iii) moving both the drum and the laser beam. Such manipulations are within the abilities of those skilled in the art. The drum may be moved by means of a rotary table which is, in a preferred embodiment, controlled by a computer system, and the optics (and/or laser itself) may be moved by means of a conventional drive mechanism which is capable of imparting the required degree of movement to the beam and which, in a preferred embodiment, is also controlled by a computer system. In this way, the entire operation of laser etching can be completely automated. Such computer control of the positioning of a work piece and/or laser beam is well known in the art and numerous computer hardware systems and the attendant software are commercially available.

Referring now to the drawings, wherein like reference numerals designate identical or corresponding parts throughout the several view, FIG. 1 schematically illustrates an apparatus for carrying out the present method. In this embodiment a robot (1) is used to transfer the drum from a conveyor to a rotary table (2), which is housed in a safety enclosure (3). The laser (4) is located adjacent to the safety enclosure (3).

Figure 2B:
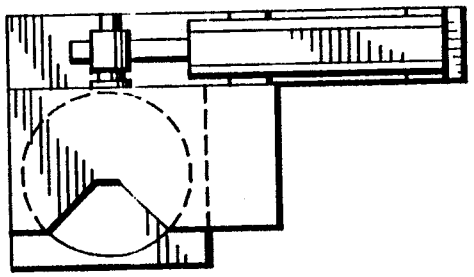
FIGS. 2*a* and *b* illustrate an apparatus for carrying out the present invention.
Figure 2A:
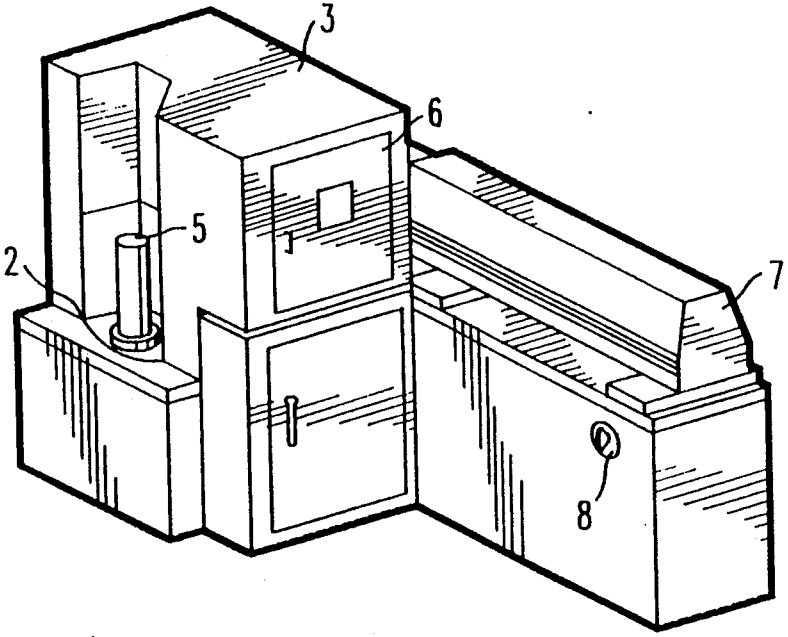

FIG. 2*a* also illustrates an apparatus for carrying out the present method. As in FIG. 1, the drum (5) is placed on a rotary table (2) which is housed in a safety enclosure (3). The safety enclosure (3) is equipped with an access door (6) with viewport. The laser is mounted on a laser rail (7) and may be adjusted along the Z axis with a manual Z axis adjust (8). FIG. 2*b* presents a top view of the same apparatus.

Figure 3A:
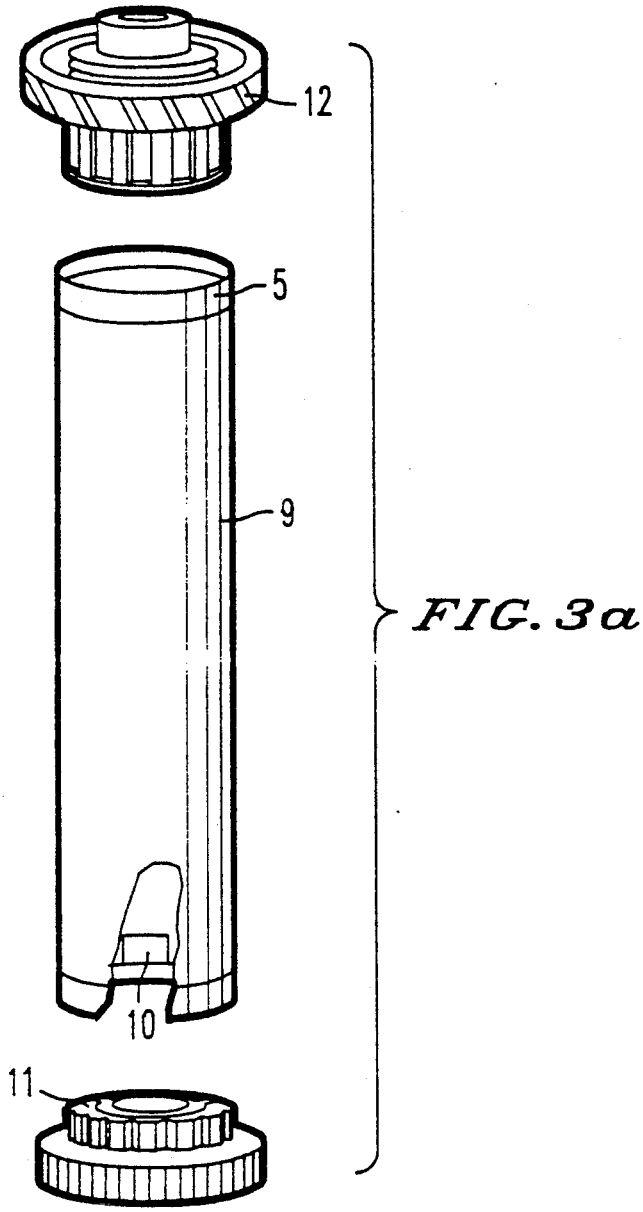
FIGS. 3*a* and *b* illustrate a first embodiment of the photoconductor drum, having a non-conductive layer, with an area of electrical contact prepared by the present method.
Figure 3B:
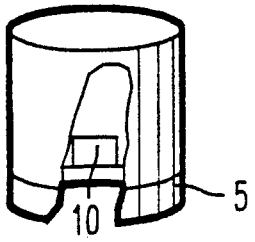

FIG. 3*a* depicts a drum with an area of electrical contact according to the present invention. The drum (5) is coated with a layer of photoconductor (9). The area of electrical contact (10) is on the inside surface of the drum and is in the shape of a rectangle. When installed into, e.g., a photocopier, a conductive material flange (11) would be inserted into the drum at the end containing the area of electrical contact, and a drive gear (12) would be inserted into the other end of the drum. FIG. 3*b* provides an enlargement of the end of the drum with the area of electrical contact.

Figure 4A:
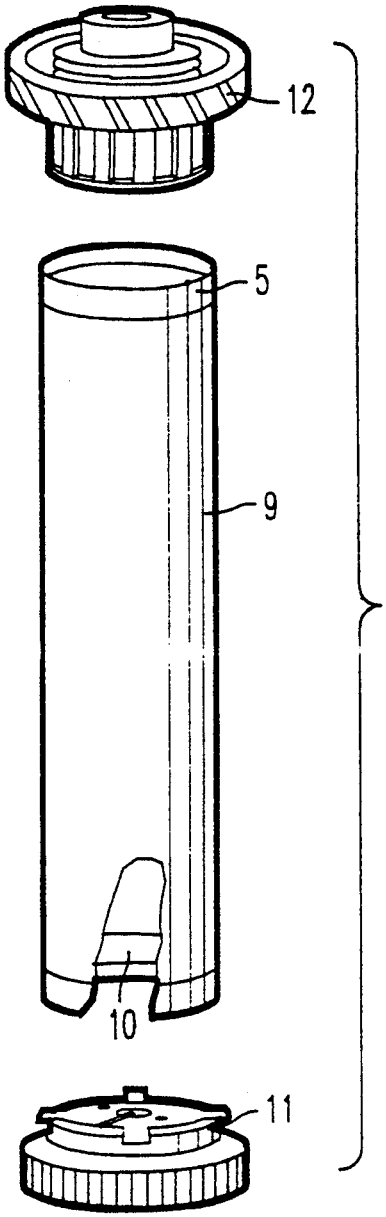
FIGS. 4*a* and *b* illustrate a second embodiment of the photoconductor drum, having a non-conductive layer, with an area of electrical contact prepared by the present method.
Figure 4B:
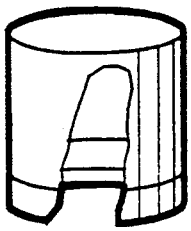

FIGS. 4*a* and *b* depict a drum (5) similar to that shown in FIGS. 3*a* and *b*, except that the area of electrical contact (10) is in the shape of a continuous band on the inside surface of one end of the drum.

As noted above, the present method offers a number of advantages. First, there is practically no loss or fall out rate (defined as the percentage of units found to be defective) due to the laser etching step. In contrast, manual grinding is accompanied by a 1% loss rate and masking techniques are attended by a 2 to 5% loss rate. Further, the present method is completely reliable and yields a drum with a good electrical contact 100% of the time. In contrast, masking techniques are so unreliable that manual grinding must be employed on every drum so treated to ensure adequate electrical contact for a given lot. Hence, masking techniques are essentially useless. Even manual grinding yields 5 to 10% of drums with poor electrical contact.

The drums produced by the present process also display a number of advantages as compared to those prepared by other methods. The present drums are not marred by scratches, which arise from mechanical grinding, or areas exposed to chemical drips, which arise from chemical etching or masking techniques. Further, The present drums are characterized by a smooth and even surface in the area of electrical contact. In contrast, the drums subjected to either mechanical or manual grinding are marred by scratches. The drums subjected to masking techniques often exhibit poor electrical contact, and both masking techniques and chemical etching can leave chemical residues on the drum. Moreover, chemical etching can suffer from the problem of leakage from the bonnet which can cause drips. In addition, if the chemical etch is too deep, then there might not be good contact between the drum and the insert, which can lead to arcing and loss of conductivity.

Although it was previously known to use lasers to inscribe indicia on nonanodized drums, the fact that the present method would be successful was completely unexpected, for a number of reasons. First, the method of the present invention involves removing a layer of non-conductive material, which was expected to cause a high degree of local heating. It was expected that this localized heating would give rise to problems with the adherence of the photoconductor layer to the drum. It was also expected that the localized heating would give rise to electrostatic or memory problems with the coating layer.

Another serious consideration which raised doubts about the ultimate success of the present method was that, since metals such as aluminum are good heat conductors, the application of the laser beam to the drum would cause heat to be transmitted to the coating layer and cause decomposition of the coating layer. For example, in many drums the coating layer contains a polymer such as polycarbonate, and it is known that temperatures as low as 270° F. can give rise to defective drums due to the thermal sensitivity of the coating layer. Thus, the possibility that the use of a laser beam would generate heat which would be conducted to and adversely affect the photoconductive layer raised serious doubts about the ultimate success of the present method. However, the inventors have discovered that the present method exhibits none of these drawbacks and that the present drums exhibit none of these deficiencies.

Other features of the invention will become apparent in the course of the following descriptions of exemplary embodiments which are give for illustration of the invention and are not intended to be limiting thereof.

EXAMPLES

A drum (hollow cylinder) of anodized aluminum, having an outer diameter of 30 mm, a length of 26 cm, and a wall thickness of 1.00 mm, and coated with a photoconductive layer on the outside surface, was etched with a laser using the apparatus depicted in FIGS. 2*a* and *b*. The laser employed was a Signature Nd:YAG laser (wavelength, 1.064 nm; maximum power, 50 Watts) manufactured by Control Laser of Orlando, Fla. The etch was carried out using a power setting of 30 Watts and a rectangle having dimensions 5 mm×9 mm was etched on the inside surface of one end of the drum using an exposure time of about 0.064 sec/mm$^2$ of etched surface.

The drum so produced was free of scratches and chemical residue on the surface of the area of electrical contact. Further, the area of electrical contact was characterized by a smooth and even surface. Moreover, the drum exhibited excellent electrical contact between the drum and the ground and no adverse effects on the photoconductive layer were observed.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A method for manufacturing a photoconductor drum having an anodized layer, with an area of electrical contact, comprising:

(i) etching a portion of a surface of a metal drum, having an anodized layer, with a laser beam to substantially remove the anodized layer from said portion of said surface.

2. The method of claim 1, wherein said portion of said surface has a surface area of at least 1 mm$^2$.

3. The method of claim 1, wherein said laser etching results in the removal of 50 to 100 μm of the metal beneath the anodized layer which is removed.

4. The method of claim 1, wherein said etching is carried out with a laser power of 10 to 200 Watts.

5. The method of claim 1, wherein said etching is carried out by exposing the surface for a time of 0.01 to 0.2 sec per mm$^2$ of surface etched.

6. The method of claim 1, wherein said metal is aluminum.

7. In a method for manufacturing a conductive photoconductor drum having an anodized layer, comprising coating at least a portion of the outside surface of a metal drum, having an anodized layer, with a photoconductor and removing the anodized layer from a portion of the surface of the metal drum, to form an area of electrical contact, the improvement being said removing being carried out by means of a laser beam.

8. The method of claim 7, wherein said portion of said surface from which said anodized layer is removed has a surface area of at least 1 mm$^2$.

9. The method of claim 7, wherein said laser etching results in the removal of 50 to 100 μm of the metal beneath the anodized layer which is removed.

10. The method of claim 7, wherein said metal is aluminum.

11. The method of claim 7, wherein said etching is carried out with a laser power of 10 to 200 Watts.

12. The method of claim 7, herein said etching is carried out by exposing the surface for a time of 0.01 to 0.2 sec per mm$^2$ of surface etched.

13. A photoconductor drum, having an anodized layer, produced by a process, comprising:

(i) etching a portion of a surface of a metal drum, having an anodized layer, with a laser beam to substantially remove the anodized layer from said portion of said surface.

14. The drum of claim 13, wherein said portion of said surface has a surface area of at least 1 mm$^2$.

15. The drum of claim 13, wherein said laser etching results in the removal of 50 to 100 μm of the metal beneath the non-conductive layer which is removed.

16. The drum of claim 13, further comprising coating said non-conductive metal drum with a photoconductor layer before said etching.

17. The drum of claim 13, wherein said etching is carried out with a laser power of 10 to 200 Watts.

18. The drum of claim 13, wherein said etching is carried out by exposing the surface for a time of 0.01 to 0.2 sec per mm$^2$ of surface etched.

19. The drum of claim 13, wherein said metal is aluminum.

* * * * *